US005448343A

United States Patent [19]

Nakamichi et al.

[11] Patent Number: 5,448,343

[45] Date of Patent: Sep. 5, 1995

[54] IMAGE FORMING APPARATUS WITH SHOCK INHIBIT DEVICE

[75] Inventors: Kiyoshi Nakamichi; Futoshi Okabayashi, both of Hyogo, Japan

[73] Assignee: Fujitsu Limited, Kawasaki, Japan

[21] Appl. No.: 207,196

[22] Filed: Mar. 8, 1994

[30] Foreign Application Priority Data

Jun. 30, 1993 [JP] Japan ..... 5-161801

[51] Int. Cl.[6] ..... G03G 15/14

[52] U.S. Cl. ..... 355/271; 355/309; 355/315

[58] Field of Search ..... 355/271, 272, 273, 274, 355/275, 276, 308–315

[56] References Cited

U.S. PATENT DOCUMENTS 3,893,760 7/1975 Thettu ..... 355/315
5,153,654 10/1992 Yaminamochi et al. ..... 355/271 X
5,200,782 4/1993 Castelli et al. ..... 355/271 X

OTHER PUBLICATIONS

Patent Abstracts of Japan, vol. 13, No. 267 (M840) Abs. Publ Date Jun. 20, 1989 for 01-69434 pub. Mar. 15, 1989.

Patent Abstracts of Japan, vol. 14, No. 27, (P992), Abs. Publ. Dt. Jan. 19, 1990 for 01-267677 Pub. Oct. 25, 1989.

English Abstract of Japanese Document 3-39985 Published Feb. 20, 1991.

*Primary Examiner*—R. L. Moses

*Attorney, Agent, or Firm*—Armstrong, Westerman, Hattori, McLeland and Naughton

[57] ABSTRACT

An image forming apparatus wherein an undesirable shock of the transfer sheet is inhibited by a shock inhibit device in at least either of a first period during which the leading end of the transfer sheet passes in the neighborhood of the second roller and a second period during which the trailing edge of the transfer sheet passes in the neighborhood of the first roller.

11 Claims, 4 Drawing Sheets

IMAGE FORMING APPARATUS WITH SHOCK INHIBIT DEVICE

TECHNICAL FIELD

The present invention relates to an image forming apparatus in which a toner image formed from charged toner and carried by an image carrying member is transferred onto a transfer sheet, and to an image forming apparatus especially suitable for use in an electrophotographic apparatus such as an electrophotographic copying machine, electrophotographic printer or facsimile.

BACKGROUND ART

In such an electrophotographic image forming apparatus which employs, for example, a photosensitive drum as an image carrying member, it is known to perform the following basic electrophotographic process in which reverse development method is employed:

Firstly, the surface of a photosensitive drum is uniformly charged by a charger in a dark place. For exposure, light is then directed from an exposure device to an image portion formed on the surface of the photosensitive drum thus uniformly charged and the electrical charge on the illuminated image portion is eliminated to decrease the electric potential, thereby forming an electrostatic latent image of a square well potential. Thereafter, toner, which is charged to the same polarity as that of the uniform charge applied on the surface of the photosensitive drum, is adhered to the electrostatic latent image by a developing device, utilizing an electric field formed by a developing bias, in order to form a visible toner image. Sequentially, a transfer sheet is overlaid on the toner image and electrical charge opposite in polarity to the charge of the toner is applied to the transfer sheet by a transfer device so that the toner image is transferred onto the transfer sheet owing to electrostatic force. The transfer sheet is further discharged by a discharging separator to reduce the electrostatic attraction force effecting on the photosensitive drum so that the transfer sheet is separated from the photosensitive drum. Thereafter, heat or pressure is applied by the fixing device to the toner image which has been transferred onto the transfer sheet so as to be fused to form a permanent image.

The transfer device is disposed in an opposed position to the photosensitive drum with a delivery path for the delivery of the transfer sheet interposed therebetween. A discharging separator is, likewise, disposed opposite to the photosensitive drum with the delivery path interposed therebetween and located adjacent to the transfer device downstream in the sheet delivery direction of the delivery path. In the upstream of the transfer device and the discharging separator in the sheet delivery direction of the delivery path, a pair of stand-by rollers are arranged in opposing relationship. The stand-by rollers allow the leading edge of the transfer sheet, which has been sent out of a cassette or tray by any of known separation means, to be in register with the leading edge of a toner image electrostatically held by the photosensitive drum. The stand-by rollers also function to send the transfer sheet to the transfer device and then to the discharging separator, adjusting it so as not to deflect diagonally from the sheet delivery direction. In the downstream of the stand-by rollers in the sheet delivery direction of the delivery path, a fixing device comprising a fixing roller and a pressure roller which are arranged in opposing relationship is disposed such that the distance between the stand-by rollers and the fixing device is not more than the length of the transfer sheet running in parallel with its delivery direction and such that the transfer device and the discharging separator are positioned between the stand-by rollers and the fixing device.

In the conventional image forming apparatus, or more particularly, in a discharging separator of the above type, the transfer sheet is discharged by the discharging separator, such that the entire part of the transfer sheet can be evenly separated from the photosensitive drum.

DISCLOSURE OF THE INVENTION

The conventional discharging separator however presents the following problems. Since it exhibits excellent separability and the transfer sheet is discharged in order to achieve uniform separation on the entire transfer sheet, if the leading edge of the transfer sheet is curled, and the curled edge does not directly pass between the fixing roller and the pressure roller in a direction tangential to the peripheral faces of these rollers, the curled edge hits the peripheral faces of the rollers. The shock caused when the curled edge of the transfer sheet hits the peripheral surface of the rollers is transmitted to a portion of the transfer sheet subjected to image transfer, which causes displacement of the transferred images. Furthermore, the fixing roller is expanded by heating, causing a difference between the peripheral speed of the fixing roller and that of the photosensitive drum etc., and as a result, the transfer sheet is warped at a portion positioned between the fixing device and the transfer device as well as the discharging separator. The warp of the transfer sheet causes the trailing edge of the transfer sheet to escape to the side of the stand-by rollers and hit their peripheral faces just after being released from these rollers. The shock occurring at that time is transmitted to a portion of the transfer sheet subjected to image transfer adjacent to the rollers, resulting in displacement of the transferred images.

Bearing the foregoing problems inherent to the prior art in mind, the present invention aims to provide an image forming apparatus in which displacement of a transferred image caused by a shock of the transfer sheet can be prevented.

The above and other objects can be achieved by an image forming apparatus according to the invention comprising:

(a) an image carrying member for carrying a toner image formed from charged toner;

(b) a first roller for delivering a transfer sheet to the image carrying member;

(c) a transfer device for transferring the toner image from the image carrying member onto the transfer sheet delivered by the first roller;

(d) a second roller for delivering, from the image carrying member, the transfer sheet bearing the toner image which has been transferred thereto by the transfer device; and (e) shock inhibit means for inhibiting a shock of the transfer sheet at least in either of a first period during which the leading edge of the transfer sheet passes in the neighbourhood of the second roller and a second period during which the trailing edge of the transfer sheet passes in the neighbourhood of the first roller.

In the above image forming apparatus, a transfer sheet is delivered to the image carrying member by means of the first roller, and after a toner image formed from charged toner and carried by the image carrying member being transferred onto the transfer sheet by the transfer device, the transfer sheet is delivered from the image carrying member by the second roller. A shock of the transfer sheet is inhibited by the shock inhibit means in at least either of the first period during which the leading edge of the transfer sheet passes in the neighbourhood of the second roller and the second period during which the trailing edge of the transfer sheet passes in the neighbourhood of the first roller. More specifically, in cases where a shock of the transfer sheet is inhibited in the first period during which the leading edge of the transfer sheet passes in the neighbourhood of the second roller, even if the leading edge of the transfer sheet hits the peripheral face of the second roller etc., the shock caused by hitting is prevented from being transmitted to a portion of the transfer sheet subjected to image transfer. On the other hand, in cases where a shock of the transfer sheet is inhibited in the second period during which the trailing edge of the transfer sheet passes in the neighbourhood of the first roller, escaping of the transfer sheet due to warping is prevented at the moment its trailing edge is released from the first roller so that no shock due to the escaping is transmitted to a portion of the transfer sheet subjected to image transfer.

With the above arrangement, in cases where a shock of the transfer sheet is inhibited in the first period during which the leading edge of the transfer sheet passes in the neighbourhood of the second roller such as a fixing roller, a shock caused when the leading edge of the transfer sheet hits the peripheral face of the second roller etc. is not transmitted to a portion subjected to image transfer, so that image displacement does not occur.

Further, in cases where a shock of the transfer sheet is inhibited in the second period during which the trailing edge of the transfer sheet passes in the neighbourhood of the first roller such as a stand-by roller, even if the transfer sheet is warped, its trailing edge is prevented from escaping to the first roller when it is released from the first roller, so that image displacement caused by a shock does not occur.

The first period is preferably a period between the time when the leading edge of the transfer sheet reaches a position about 22 mm in front of the second roller and when the leading edge has advanced about 3 mm after passing the second roller. The second period is preferably a period between the time when the trailing edge of the transfer sheet reaches a position about 5 mm in front of the first roller and when the trailing edge has advanced about 5 mm after passing the first roller. The first roller may be a stand-by roller and the second roller may be a fixing roller.

The shock inhibit means is preferably designed to increase an attraction force for attracting the transfer sheet to the image carrying member. Further, the shock inhibit means is preferably designed to reduce or stop discharging energy supplied to the discharging separator provided for separating the transfer sheet from the image carrying member after transfer of the toner image by the transfer device. Discharging of the transfer sheet by the discharging separator is preferably carried out using corona a.c. discharge.

The image carrying member is preferably rotated synchronously with the delivery of the transfer sheet such that the toner image carried by the image carrying member is transferred onto the transfer sheet by the transfer device at the transfer position.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitations of the present invention, and wherein:

FIG. 1 is a schematic view of the image forming apparatus according to one embodiment of the invention which is incorporated in a laser printer;

FIG. 2 is a flow chart of an ON/OFF control program for the d.c. power supply and the a.c. power supply shown in FIG. 1;

FIG. 3 is a time chart corresponding to the flow chart of FIG. 2;

FIG. 4 is a diagram for explaining, in conjunction with FIG. 2, the period between the time when the leading edge of a transfer sheet travels between a position just before reaching a fixing roller and a pressure roller and a position where the leading edge has passed these rollers; and FIG. 5 is a diagram for explaining, in conjunction with FIG. 2, the period between the time when the trailing edge of the transfer sheet travels between a position just before reaching a pair of stand-by rollers and a position where the trailing edge has passed these rollers.

BEST MODE FOR CARRYING OUT THE INVENTION

Reference is now made to the accompanying drawings for describing a preferred embodiment of an image forming apparatus according to the invention, the image forming apparatus being incorporated in a laser printer which is one form of electrophotographic apparatus.

Figure 1:
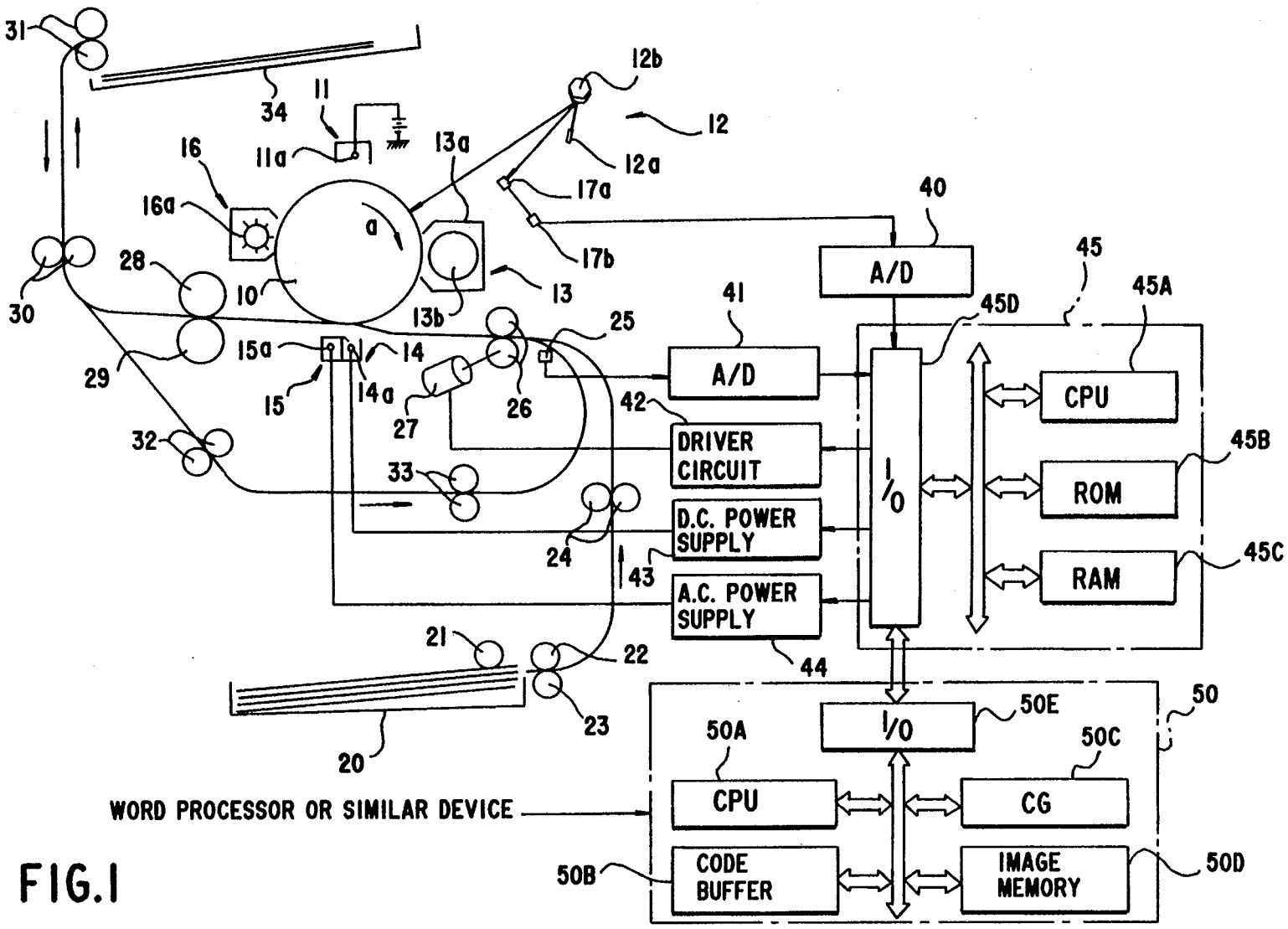
FIGS. 1 to 5 are for illustrating a preferred embodiment of an image forming apparatus according to the present invention.

FIG. 1 shows a photosensitive drum 10 composed of, for example, a cylindrical body made from aluminum with a diameter of 80 mm. The cylindrical body is grounded and has, on its peripheral face, a photosensitive layer which is formed using OPC (Organic Photoconductor) as a photoconductive material. In this embodiment, during transferring operation, the photosensitive drum 10 rotates in the direction of arrow a in the drawing at a peripheral speed of 133 m/s. Disposed around the photosensitive drum 10 are a charger 11, an exposure device 12, a developing device 13, a transfer device 14, an AC discharging separator 15 and a cleaner 16 which are arranged in this order in the direction of arrow a, facing to the photosensitive drum 10.

There will be explained the charger 11, exposure device 12, developing device 13, transfer device 14, AC discharging separator 15 and cleaner 16 in order.

(a) Charger 11

The charger 11 includes a corona wire 11*a* to which electrical energy of a specified negative current is supplied from a d.c. power supply. With this energy, corona discharge is induced in a dark place and corona charge having minus ions is applied to the photosensitive drum 10, i.e. the OPC photosensitive layer, so that the surface of the OPC photosensitive layer is uniformly charged by a negative charge. In this embodiment, the surface of the OPC photosensitive layer is charged to an electric potential of up to −600 V.

(b) Exposure device 12

The exposure device 12 has an optical scan system including a semiconductor laser 12*a* and a polygonal mirror 12*b*. A laser beam is directed from the optical scan system to the uniformly charged photosensitive drum 10 in accordance with image data sent from a word processor, microcomputer or the like so that an electrostatic latent image is formed on the photosensitive drum 10. The formation of an electrostatic latent image is performed as follows: A laser beam is directed to the surface of the uniformly charged photosensitive drum 10, i.e., image portions formed on the surface of the OPC photosensitive layer. The negative charge in the area of the surface of the OPC photosensitive layer where the laser beam strikes is eliminated to decrease the potential to −100 V in this embodiment, thereby forming a square well potential. The elimination of the negative charge from the surface of the OPC photosensitive layer by using laser beam is performed by utilizing the characteristic of the OPC layer made from a photoconductive material which can be brought into its conductive state by a laser beam impinging thereon. When the OPC layer is in its conductive state, the negative charge escapes from the OPC layer through the cylindrical body of the photosensitive drum 10 made from aluminum.

Reference numerals 17*a*, 17*b* represent a horizontal synchronization mirror and a beam detection sensor, respectively. The horizontal synchronization mirror 17*a* is disposed at a reference position for starting of scan by a laser beam emitted from the optical scan system, and the beam detection sensor 17*b* detects the laser beam reflected by the horizontal synchronization mirror 17*a*.

(c) Developing device 13

The developing device 13 includes a hopper 13*a* for storing coloring particle material, generally referred to as toner and a toner feed roller 13*b* for feeding the toner to the surface of the photosensitive drum 10. The toner stored in the hopper 13*a* is negatively charged to the same polarity as that of the uniform charge on the photosensitive drum 10 by triboelectric charging with carrier, charge injection or the like. When the electrostatic latent image formed on the photosensitive drum 10 passes through the developing device 13, reverse development utilizing the magnetic brush development method is carried out in this embodiment. More specifically, the toner negatively charged is affixed to the electrostatic latent image of a square well potential as if it buries the electrostatic latent image, owing to the electric field established by a developing bias voltage of −400 V, whereby the electrostatic latent image is developed into a visible toner image.

(d) Transfer device 14

The transfer device 14 of this embodiment has a corona wire 14*a* to which electrical energy of a constant positive current of 200 μA is supplied. With this electrical energy supplied to the corona wire 14*a*, corona discharge is induced as explained in the description of the charger 11 and a corona charge having plus ions is applied to a transfer paper (one form of the transfer sheet) from its back side, the transfer paper being delivered, overlaid on the toner image electrostatically held by the photosensitive drum 10. Thus, the transfer paper is positively charged to the polarity opposite to the charge on the toner image. Therefore, when the transfer paper passes between the photosensitive drum 10 and the transfer device 14, the positively charged transfer paper is adhered by electrostatic force to the photosensitive drum 10 which is negatively charged by the charger 11, and the toner constituting the image that is electrostatically held by the photosensitive drum 10 is transferred onto the transfer paper, whereby the electrostatic transfer of the toner image is performed. In this embodiment, the photosensitive drum 10 rotates at a peripheral speed of 133 mm/s as above noted, and the speed of delivering the transfer paper corresponds to this peripheral speed, so that the toner image is electrostatically transferred onto the transfer paper by the transfer device 14 at the transfer position.

(e) AC discharging separator 15

The AC discharging separator 15 of this embodiment is adjacent to the transfer device 14 and has a corona wire 15*a* to which electrical energy having an a.c. voltage of 11.8 KV offset by an offset voltage of −700 V is supplied. With the electrical energy supplied to the corona wire 15*a*, a.c. corona discharge is induced to discharge the transfer paper from its back side, the transfer paper bearing the toner image which has been charged by the transfer device 14, electrostatically transferred thereto and being electrostatically adhered to the photosensitive drum 10. Accordingly, when the transfer paper passes between the photosensitive drum 10 and the AC discharging separator 15, the charge applied by the transfer device 14 is eliminated from the transfer paper, thereby reducing the electrostatic attraction force by which the transfer paper is attracted to the photosensitive drum 10. Consequently, the transfer paper is separated from the photosensitive drum 10.

(f) Cleaner 16

The efficiency of transferring a toner image onto the transfer paper by the transfer device 14 is dependent on the amount of charge on the transfer paper, and part of charged toner forming the toner image remains on the surface of the photosensitive drum 10. Such residual toner is removed from the photosensitive drum 10 by the cleaner 16 and the surface of the photosensitive drum 10 is uniformly charged by a negative charge by the charger 11 again. The cleaner 16 may comprise a fur brush 16*a*.

Next, there will be given an explanation on the delivery path through which the transfer paper travels from a paper feed tray 20 for storing the transfer paper to a receiving tray 34 for receiving the transfer paper bearing a toner image which has been transferred and fused thereon. The following description is based on the case of "double-sided image transfer".

The transfer paper is firstly picked up from the paper feed tray 20 by a pick-up roller 21 and then delivered between a feed roller 22 and a reversing roller 23 which are arranged in opposing relationship. After the transfer paper has sequentially passed between a first pair of opposed delivery rollers 24, 24, the leading edge of the transfer paper passes a sheet edge detection sensor 25 for detecting the leading and trailing edges of the transfer paper and the transfer paper is then delivered to a pair of opposed stand-by rollers 26, 26 which is in a stopping-state. The leading edge of the transfer paper bumps against the stand-by rollers 26, 26 in a stopping-state, whereby the transfer paper is adjusted such as not to deflect diagonally from the delivery direction of the delivery path. After the leading edge of the transfer paper has been detected by the sheet edge detection sensor 25 and diagonal deflection of the transfer paper has been adjusted, the leading edge of the transfer paper is adjusted against the leading edge of the toner image electrostatically held by the photosensitive drum 10. In this embodiment, at that time (i.e., at the start of writing the electrostatic latent image to the surface of the photosensitive drum 10 corresponding to the leading edge of the toner image), the stand-by rollers 26, 26 are activated for rotation by a motor 27 in order to deliver the transfer paper therethrough. Thereafter, the transfer paper travels between the photosensitive drum 10 and the transfer device 14 and between the photosensitive drum 10 and the AC discharging separator 15. The transfer paper then travels between a fixing roller 28 and a pressure roller 29 which are opposite to each other to constitute a fixing device. During the travel of the transfer paper between these rollers 28 and 29, the fixing roller 28 applies heat to the toner image which has been electrostatically transferred onto the surface of the transfer paper by the transfer device 14, and the pressure roller 29 applies pressure to the toner image, so that the toner image is fused on the surface of the transfer paper to form a permanent image. The transfer paper bearing the toner image permanently fused thereon is once delivered by a second pair of delivery rollers 30, 30 which are opposite to each other, being rotatable in forward and backward directions, until the leading edge of the transfer paper comes into a close vicinity of a pair of opposed assist rollers 31, 31. After that, the transfer paper is delivered by the reverse rotation of the second delivery rollers 30, 30 so as to pass sequentially between a third pair of opposed delivery rollers 32, 32 and between a fourth pair of opposed delivery rollers 33, 33. The transfer paper is then turned over and delivered until it reaches the stand-by rollers 26, 26. Just as the first circulation is performed, the transfer paper sequentially passes between the stand-by rollers 26, 26, between the photosensitive drum 10 and the transfer device 14, between the photosensitive drum 10 and the AC discharging separator 15, and between the fixing roller 28 and the pressure roller 29 and thus the toner image is fused permanently on the reverse side of the transfer paper. After completion of transfer and fusing of the toner image on both sides, the transfer paper passes between the second delivery rollers 30, 30 and between the assist rollers 31, 31 to be discharged onto the receiving tray 34.

It is to be understood that, in the case of one-sided image transfer, the transfer paper is not delivered to the stand-by rollers 26, 26 again through the third and fourth delivery rollers 32, 32 and 33, 33, but directly discharged onto the receiving tray 34 from the assist rollers 31, 31.

There will be finally described a mechanical controller 45 and a host controller 50. The mechanical controller 45 inputs a beam detection signal which is sent from the beam detection sensor **17*b* through an A/D convertor 40 upon detection of a laser beam by the beam detection sensor 17*b* and inputs a sheet edge detection signal which is sent from the sheet edge detection sensor 25 through an A/D convertor 41 upon detection of the leading or trailing edge of the transfer paper by the sheet edge detection sensor 25. The mechanical controller 45 outputs a drive control signal to a driver circuit 42 for controlling the drive of the motor 27 for rotating the stand-by rollers 26, 26; an ON/OFF control signal to a d.c. power supply 43 for supplying electrical energy of a constant positive current of 200 $\mu$A to the corona wire 14*a* of-the transfer device 14; and an ON/OFF control signal to an a.c. power supply 44 for supplying electrical energy having an a.c. voltage of 11.8 KV offset by an offset voltage of $-700$ V to the corona wire 15*a* of the A.C. discharging separator 15**.

The mechanical controller 45 for controlling the laser printer comprises: a central processing unit (CPU) 45A; a read only memory (ROM) 45B for storing an operation program for the laser printer, an ON/OFF control program for the d.c. power supply 43, an ON/OFF control program for the a.c. power supply 44 and constants etc.; and a random access memory (RAM) 45C into which temporary data can be written and from which temporary data can be read; and an input/output interface (I/O) 45D through which input and output operations are conducted. Concretely, the following operations are executed through the I/O 45D: input of the beam detection signal and the paper edge detection signal to the mechanical controller 45, the signal converted into digital signals by the A/C convertors 40 and 41; output of the drive control signal from the mechanical controller 45 to the driver circuit 42; and output of the ON/OFF control signals from the mechanical controller 45 to the d.c. power supply 43 and the a.c. power supply 44.

The host controller 50 comprises: a central processing unit (CPU) 50A; a code buffer 50B for temporarily storing character code data transmitted from a host computer; a character generator (CG) 50C for converting character code data read from the code buffer 50B into image data for display; an image memory 50D comprising a bit map memory for sequentially storing image data into which the character code data is converted by the CG 50C, the memory 50D having a capacity of storing at least one page of print data; and an input/output interface (I/O) 50E for providing the connection between the host controller 50 and the mechanical controller 45 so that input and output operations between these controllers are conducted through the I/O 50E and I/O 45D.

Writing of an electrostatic latent image for forming an electrostatic latent image on the photosensitive drum 10 by the laser optical scan system of the exposure system 12 is performed as follows.

After the sheet edge detection sensor 25 has released a sheet edge detection signal to the mechanical controller 45 through the A/D convertor 41 upon detection of the leading edge of the traveling transfer paper, the mechanical controller 45 releases a print data request signal to the host controller 50. Upon receipt of the print data request signal, the host controller 50 reads character code data, which has been sent from the word processor or a similar device for temporary storage, to convert into image data. Such image data pieces are sequentially stored again and when one page of image data has been stored, the host controller 50 releases a start signal to the mechanical controller 45. After receiving the start signal, the mechanical controller 45 sets a timing signal for writing one page of electrostatic latent images on the photosensitive drum 10 to High level, at the time when the beam detection sensor 17*b* releases a first detection signal to the mechanical controller 45 via the A/D convertor 40, detecting a laser beam reflected off the horizontal synchronization mirror 17*a* which is provided at a reference position for starting laser beam scan. The mechanical controller 45 also outputs a drive control signal to the driver circuit 42 in order to instruct the actuation of the motor 27 for rotating the pair of stand-by rollers 26, 26 in a stopping-state. It is to be noted that, after an elapse of a predetermined time (180 msec. in this embodiment) after the sheet edge detection sensor 25 has detected the trailing edge of the traveling transfer paper, and output a sheet edge detection signal to the mechanical controller 45 through the A/D convertor 41, the timing signal for writing one page of electrostatic latent images which was set to High level is set to Low level and a drive control, signal for stopping the motor 27 is released to the driver circuit 42 in order to stop the rotation of the stand-by rollers 26, 26.

The mechanical controller 45 releases a horizontal synchronization signal to the host controller 50 each time a beam detection signal is input, until writing of one page of electrostatic latent images is completed, in other words, until the timing signal for writing one page of electrostatic latent images is set to Low level. The host controller 50 releases stored image data line by line to the mechanical controller 45 each time horizontal synchronization signal is input into the host controller 50. Accordingly, the mechanical controller 45 performs the ON/OFF control (not shown in the drawings) of the semiconductor laser 12*a* of the laser optical scan system in the exposure device 12, in accordance with image data, i.e., video signals, thereby writing electrostatic latent images on the photosensitive drum 10.

Figure 2:
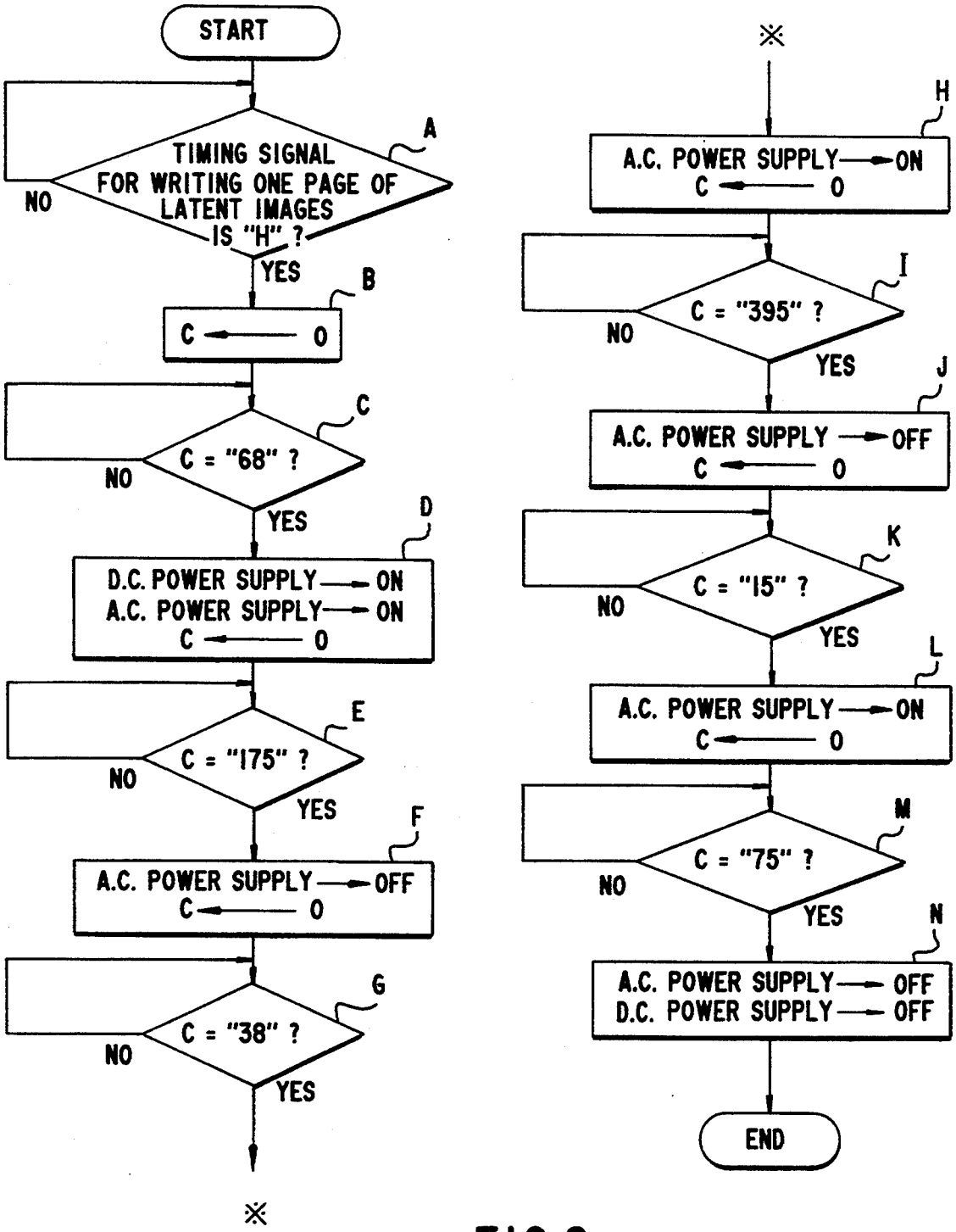
Figure 3:
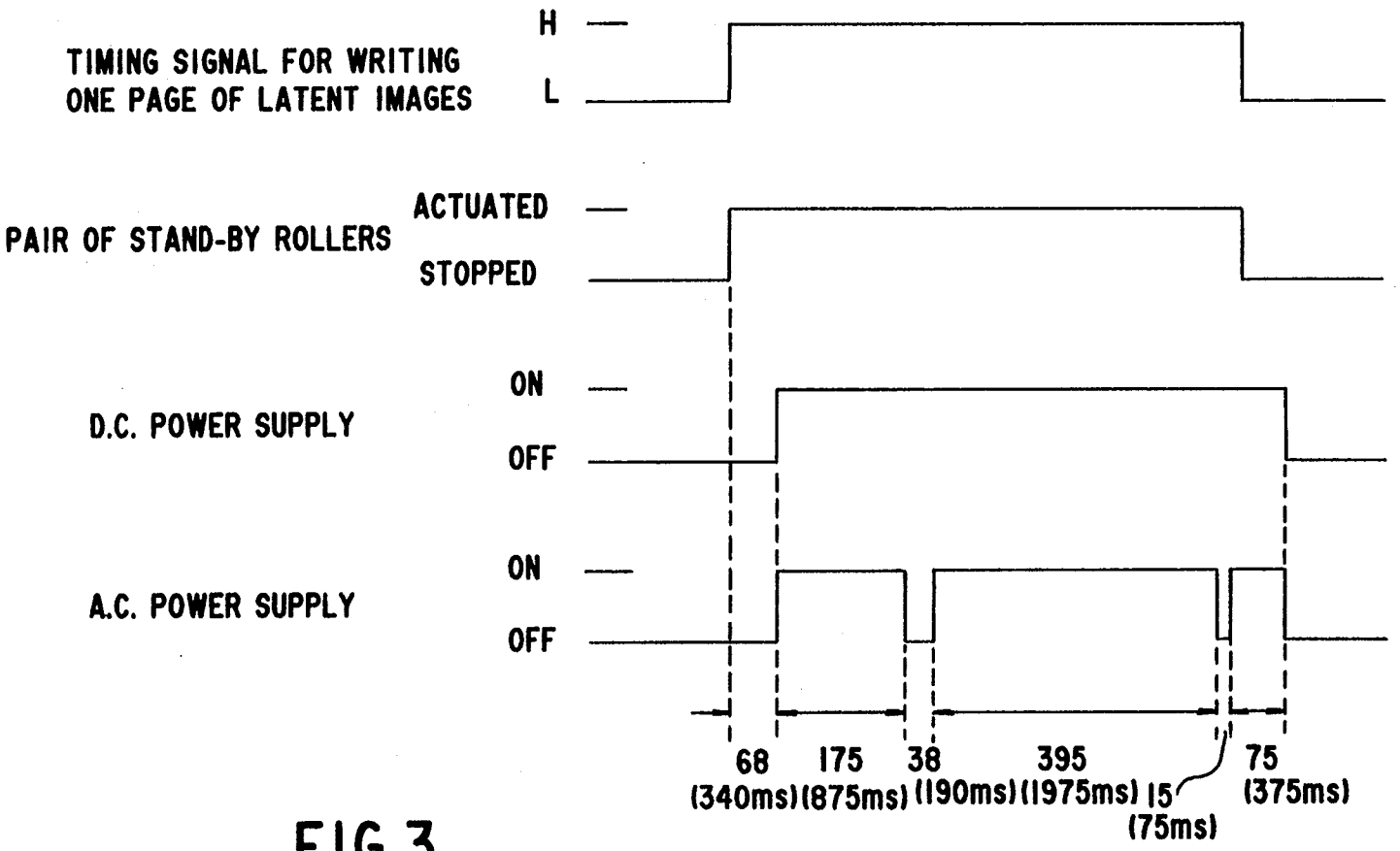

Reference is now made to the flow chart of FIG. 2 and the time chart of FIG. 3, for describing an ON/-OFF control program for the d.c. power supply 43 for supplying electrical energy of a constant positive current of 200 μA to the corona wire 14*a* of the transfer device 14 and an ON/Off control program for the a.c. power supply 44 for supplying electrical energy having an a.c. voltage of 11.8 KV offset by an offset voltage of −700 V to the corona wire 15*a* of the AC discharging separator 15. In the following description, the operating conditions are as follows: An A4 size transfer paper oriented longitudinally is delivered. The photosensitive drum 10 has a diameter of 80 mm and its peripheral speed is 133 mm/s. The counter C counts clock signals generated at intervals of 5 ms.

It is judged whether or not the timing signal for writing one page of electrostatic latent images on the photosensitive drum 10 has been set to High level (Step A), and if so, the counter C is cleared (Step B). When the count number of the counter C reaches "68 (340 ms)" (Step C), in other words, when the leading end of the transfer paper reaches the inlet of the transfer device 14, the d.c. power supply 43 and the a.c. power supply 44 are both turned ON, so that the corona wire 14*a* of the transfer device 14 is supplied with electrical energy of a constant positive current of 200 μA and the corona wire 15*a* of the AC discharging separator 15 is supplied with electrical energy having an a.c. voltage of 11.8 KV offset by an offset voltage of −700 V, and the counter C is cleared (Step D).

Figure 4:
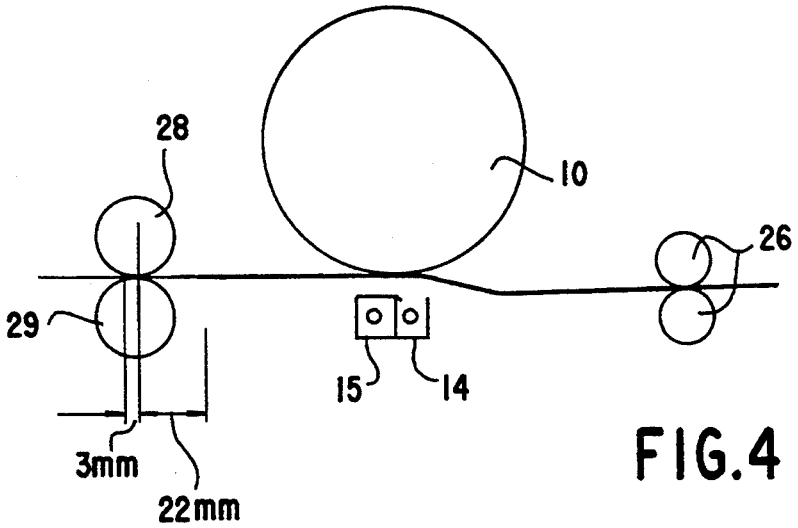

When the count number of the counter C reaches "175 (875 ms)" (Step E) and the leading edge of the transfer paper reaches, as shown in FIG. 4, a position which is 22 mm in front of the fixing roller 28 and the pressure roller 29, the a.c. power supply 44 is turned OFF thereby stopping the supply of electrical energy of a.c. voltage to the corona wire 15*a* of the AC discharging separator 15, and the counter C is cleared (Step F). When the count number of the counter then reaches "38 (190 ms)" (Step G) and the leading edge of the transfer paper has advanced 3 mm after passing between the fixing roller 28 and the pressure roller 29, the a.c. power supply 44 is turned ON again, thereby supplying electrical energy having an a.c. voltage of 11.8 KV offset by an offset voltage of −700 V to the corona wire 15*a* of the AC discharging separator 15, and the counter C is cleared (Step H).

Figure 5:
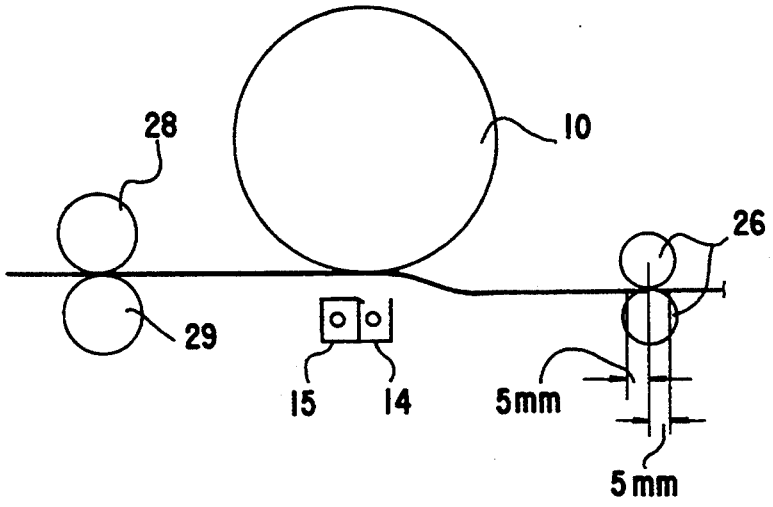

When the count number of the counter reaches "395 (1975 ms)" (Step I) and the trailing edge of the transfer paper reaches, as shown in FIG. 5, a position which is 5 mm in front of the stand-by rollers 26, 26, the a.c. power supply 44 is turned OFF thereby stopping the supply of electrical energy of a.c. voltage to the corona wire 15*a* of the AC discharging separator 15, and the counter C is cleared (Step J). When the count number of the counter C reaches "15 (75 ms)" (Step K) and the trailing edge of the transfer paper has advanced 5 mm after passing between the stand-by rollers 26, 26, the a.c. power supply 44 is turned ON again, thereby supplying electrical energy having an a.c. voltage of 11.8 KV offset by an offset voltage of −700 V to the corona wire 15*a* of the AC discharging separator 15, and the counter C is cleared (Step L).

Finally, when the count number of the counter C reaches "75 (375 ms)" (Step M), in other words, when the trailing edge of the transfer paper reaches the outlet of the AC discharging separator 15, the d.c. power supply 43 and the a.c. power supply 44 are both turned OFF, thereby stopping the supply of electrical energy of a constant current to the corona wire 14*a* of the transfer device 14 and the supply of electrical energy of a.c. voltage to the corona wire 15*a* of the AC discharging separator 15.

It is understood from the above description that, during the period between the time when the leading edge of the transfer paper travels from a position 22 mm in front of the fixing roller 28 and the pressure roller 29 to a position where it has advanced 3 mm after passing these rollers 28 and 29, the supply of electrical energy having an a.c. voltage of 11.8 KV offset by an offset voltage of −700 V to the corona wire 15*a* of the AC discharging separator 15 is stopped, thereby stopping discharging of the transfer paper, so that the electrostatic attraction force generated between the transfer paper and the photosensitive drum 10 is not reduced. Therefore, even if the leading edge of the transfer paper hits the peripheral face of the fixing roller 28 or the pressure roller 29 in this period, a shock caused by the hit will not be transmitted to a portion of the transfer sheet subjected to image transfer, and as a result, no displacement of a transferred image will occur. Further, during the period between the time when the trailing edge of the transfer paper travels a position 5 mm in front of the stand-by rollers 26, 26 and when it has advanced 5 mm after passing the stand-by rollers 26, 26, the supply of electrical energy of a.c. voltage to the corona wire 15*a* of the AC discharging separator 15 is stopped, thereby stopping discharging of the transfer paper, so that the electrostatic attraction force for attracting the transfer paper to the photosensitive drum 10 is not reduced at all. With this arrangement, even if heat expansion of the fixing roller 28 caused by heating causes a difference between the peripheral speed of the fixing roller 28 and that of the photosensitive drum 10 etc., so that the transfer paper is warped in the area of the fixing roller 28, the pressure roller 29, the photosensitive drum 10, the transfer device 14 and the AC discharging separator 15, the escaping of the transfer paper to the side of the stand-by rollers 26, 26 will be prevented when its trailing edge is released from the stand-by rollers 26, 26, and as a result, displacement of a transferred image due to a shock caused by the escaping will not occur.

Although the AC discharging separator 15 of the foregoing embodiment is stopped from discharging the transfer paper in the period between the time when the leading edge of the transfer paper travels just before passing between the fixing roller 28 and the pressure roller 29 and when it has passed between these rollers 28 and 29 and in the period between the time when the trailing edge of the transfer paper travels just before passing between the stand-by rollers 26, 26 and when it has passed between the standby rollers 26, 26, the same effects of the present invention can be achieved by stopping discharging in either of the above periods. In stead of stopping the AC discharging separator 15 from discharging, the discharging power generated by the AC discharging separator 15 may be reduced by switching the electrical energy supplied to the corona wire 15*a* of the AC discharging separator 15 from an a.c. voltage of 11.8 KV offset by an offset voltage of −700 V to an a.c. voltage of 9.0 KV offset by an offset voltage of −300 V, during the period between the time when the leading edge of the transfer paper travels just before passing between the fixing roller 28 and the pressure roller 29 and when it has passed between these rollers 28 and 29 and during the period between the time when the trailing edge of the transfer paper travels just before passing between the stand-by rollers 26, 26 and when it has passed between the stand-by rollers 26, 26. In such a case, switching from an a.c. voltage of 11.8 KV offset by an offset voltage of −700 V to an a.c. voltage of 9.0 KV offset by an offset voltage of −300 V is performed by switching offset voltage or by switching P-PC (peak to peak) voltage value.

Although the transfer paper is charged utilizing corona discharge in the transfer device 14 in the foregoing embodiment, other methods may be employed to applying a charge to the transfer paper.

Although the ON/OFF control of the d.c. power supply 43 and that of the a.c. power supply 44 are timed in accordance with the setting of the signal for writing one page of electrostatic latent images to High level in the foregoing embodiment, a transfer paper detection sensor may be provided in the neighbourhood of the inlet of the transfer device 14 and a detection signal from the transfer paper detection sensor may be used for the above controls instead.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

(a) an image carrying member for carrying a toner image formed from charged toner;

(b) a first roller for delivering a transfer sheet to the image carrying member;

(c) a transfer device for transferring the toner image from the image carrying member onto the transfer sheet delivered by the first roller;

(d) a second roller for delivering, from the image carrying member, the transfer sheet bearing the toner image which has been transferred thereto by the transfer device; and (e) shock inhibit means for inhibiting a shock of the transfer sheet in at least either of a first period during which the leading edge of the transfer sheet passes in the neighborhood of the second roller and a second period during which the trailing edge of the transfer sheet passes in the neighborhood of the first roller, wherein the shock inhibit means increases an attraction force for attracting the transfer sheet to the image carrying member.

2. The image forming apparatus as claimed in claim 1, wherein the first period is a period between the time when the leading edge of the transfer sheet reaches a position about 22 mm in front of the second roller and when the leading edge has advanced about 3 mm after passing the second roller.

3. The image forming apparatus as claimed in claim 1, wherein the second period is a period between the time when the trailing edge of the transfer sheet reaches a position about 5 mm in front of the first roller and when the trailing edge has advanced about 5 mm after passing the first roller.

4. An image forming apparatus comprising:

(a) an image carrying member for carrying a toner image formed from charged toner;

(b) a first roller for delivering a transfer sheet to the image carrying member;

(c) a transfer device for transferring the toner image from the image carrying member onto the transfer sheet delivered by the first roller;

(d) a second roller for delivering, from the image carrying member, the transfer sheet bearing the toner image which has been transferred thereto by the transfer device; and (e) shock inhibit means for inhibiting a shock of the transfer sheet in at least either of a first period during which the leading edge of the transfer sheet passes in the neighborhood of the second roller and a second period during which the trailing edge of the transfer sheet passes in the neighborhood of the first roller, wherein the shock inhibit means reduces or stops discharging energy applied to a discharging separator provided for separating the transfer sheet from the image carrying member after the toner image has been transferred onto the transfer sheet by the transfer device.

5. The image forming apparatus as claimed in claim 4, wherein discharging of the transfer sheet by the discharging separator is carried out by utilizing a.c. corona discharge.

6. The image forming apparatus as claimed in claim 4, wherein the first period is a period between the time when the leading edge of the transfer sheet reaches a position about 22 mm in front of the second roller and when the leading edge has advanced about 3 mm after passing the second roller.

7. The image forming apparatus as claimed in claim 4, wherein the second period is a period between the time when the trailing edge of the transfer sheet reaches a position about 5 mm in front of the first roller and when the trailing edge has advanced about 5 mm after passing the first roller.

8. The image forming apparatus as claimed in any one of claim 1–7, wherein the image carrying member is rotated synchronously with the delivery of the transfer sheet so that the toner image carried by the image carrying member is transferred onto the transfer sheet by the transfer device at the transfer position.

9. The image forming apparatus as claimed in any one of claims 1–7, wherein the first roller is a stand-by roller and the second roller is a fixing roller.

10. The image forming apparatus as claimed in any one of claims 1–7, which is for use in an electrophotographic apparatus such as an electrophotographic copying machine, electrophotographic printer or facsimile.

11. The image forming apparatus as claimed in claim 10, wherein the electrophotographic image forming apparatus is capable of sequentially transferring and fixing the toner image on both sides of the transfer sheet.

* * * * *